US011174584B2

(12) United States Patent
Reger

(10) Patent No.: US 11,174,584 B2
(45) Date of Patent: Nov. 16, 2021

(54) INTEGRATED CAP CLEANER FOR A WASHING MACHINE APPLIANCE

(71) Applicant: Haier US Appliance Solutions, Inc., Wilmington, DE (US)

(72) Inventor: Todd Anthony Reger, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 143 days.

(21) Appl. No.: 16/244,249

(22) Filed: Jan. 10, 2019

(65) Prior Publication Data

US 2020/0224356 A1 Jul. 16, 2020

(51) Int. Cl.

| | |
|---|---|
| ***D06F 39/08*** | (2006.01) |
| ***D06F 23/04*** | (2006.01) |
| ***D06F 39/02*** | (2006.01) |

(52) U.S. Cl.

CPC ..... *D06F 39/088* (2013.01); *D06F 23/04* (2013.01); *D06F 39/022* (2013.01)

(58) Field of Classification Search

CPC ..... D06F 39/088

See application file for complete search history.

(56) References Cited

U.S. PATENT DOCUMENTS

| | | | | |
|---|---|---|---|---|
| 5,657,650 | A | 8/1997 | Lee et al. | |
| 9,541,440 | B2 | 1/2017 | Larson et al. | |
| 2009/0249838 | A1* | 10/2009 | Kim | D06F 39/083 68/58 |
| 2016/0102425 | A1 | 4/2016 | Scheckelhoff | |
| 2016/0289884 | A1* | 10/2016 | Kim | D06F 35/006 |
| 2016/0345799 | A1* | 12/2016 | Hite | E03B 7/074 |

FOREIGN PATENT DOCUMENTS

| | | | |
|---|---|---|---|
| CN | 104389145 | A | 3/2015 |

* cited by examiner

*Primary Examiner* — Spencer E. Bell

(74) *Attorney, Agent, or Firm* — Dority & Manning, P.A.

(57) ABSTRACT

A washing machine appliance having an integrated cap cleaning device is provided. The device includes features for cleaning soiled caps of liquid cleaning agent bottles. A water valve selectively allows water to flow from a water supply to the cap cleaning device. When a soiled cap is pressed against the cap cleaning device, the soiled cap depresses an activation device that triggers the water valve to allow water to flow to the cap cleaning device. The cap cleaning device includes a spout defining one or more exit nozzles. Water flowing through the cap cleaning device exits through the exit nozzles of the spout and sprays onto the soiled cap. The cap cleaning device can also include an outer rim defining a plurality of rim exit nozzles. Water flowing through the cap cleaning device can exit through the rim exit nozzles and onto exterior surfaces of the soiled cap.

18 Claims, 8 Drawing Sheets

INTEGRATED CAP CLEANER FOR A WASHING MACHINE APPLIANCE

FIELD OF THE INVENTION

The present subject matter relates generally to washing machine appliances and more particularly to integrated cap cleaners for washing machine appliances.

BACKGROUND OF THE INVENTION

Detergent is frequently added to a washing machine to enhance washing performance. Fabric softener can also be added to the washing machine. These liquid cleaning agents are typically added once per load. After pouring liquid from a container cap into the washing machine, some liquid residue usually remains in or on the cap. The liquid cleaning agent remaining in and/or on the cap may drip onto the bottle and other objects if the cap is placed back onto the bottle or may coagulate if the cap is set to the side. The surface upon which the cap is set can become soiled with the liquid drippings.

To address such challenges, consumers have resorted to washing the cap along with articles in the washing machine, washing the cap in a separate sink, or using a spray house or similar feature of the washing machine appliance. However, washing the cap in the washing machine can warp the cap, e.g., so that the cap no longer threads onto the bottle. Moreover, washing the cap in a separate sink can be inconvenient and the cap can still drip as it is moved by the consumer. In addition, spray hoses and other water features typically cause significant splashing when used to spray the cap. Consequently, the challenges associated with liquid residue remaining on the cap after use can be inconvenient for consumers.

Accordingly, a washing machine appliance that includes features that address one or more of the challenges noted above would be desirable.

BRIEF DESCRIPTION OF THE INVENTION

Aspects and advantages of the invention will be set forth in part in the following description, or may be apparent from the description, or may be learned through practice of the invention.

In one example embodiment, a washing machine appliance is provided. The washing machine appliance includes a cabinet and a tub positioned within the cabinet. The washing machine appliance also includes a basket rotatably mounted within the tub, the basket defining a wash chamber for receipt of articles for washing. Further, the washing machine appliance includes a controller and a water valve movable between an open position and a closed position. In addition, the washing machine appliance includes a cap cleaning device. The cap cleaning device includes a body in fluid communication with the water valve and defining a docking port operable to receive a cap, the body having a spout. Further, the cap cleaning device includes an activation device mounted to the body and communicatively coupled with the controller, wherein, when the activation device is triggered, the controller causes the water valve to move to the open position such that water is directed to the spout and sprayed therefrom.

In another example embodiment, a washing machine appliance is provided. The washing machine appliance includes a cabinet and a tub positioned within the cabinet. The washing machine appliance also includes a basket rotatably mounted within the tub, the basket defining a wash chamber for receipt of articles for washing. Further, the washing machine appliance includes a controller and a water valve movable between an open position and a closed position. Moreover, the washing machine appliance includes a cap cleaning device. The cap cleaning device includes a body in fluid communication with the water valve and defining a docking port operable to receive a cap, the body having an inlet port defining an inlet through which water enters the cap cleaning device, the body also having a spout defining one or more exit nozzles through which water exits the cap cleaning device. Further, the cap cleaning device includes an activation device mounted to the body and communicatively coupled with the controller. When the activation device is triggered, the controller is configured to: receive, from the activation device, an activation signal indicating that the activation device is triggered; and cause the water valve to move to the open position so that water is directed to the spout and sprayed through the one or more exit nozzles.

In yet another example embodiment, a method for operating a washing machine appliance in a cap cleaning cycle using a cap cleaning device is provided. The method includes receiving, by a controller of the washing machine appliance, an activation signal indicating initiation of the cap cleaning cycle. The method also includes causing, by the controller of the washing machine appliance in response to the received activation signal, a water valve of the washing machine appliance to allow water to flow to the cap cleaning device such that water is sprayed from a spout of the cap cleaning device.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
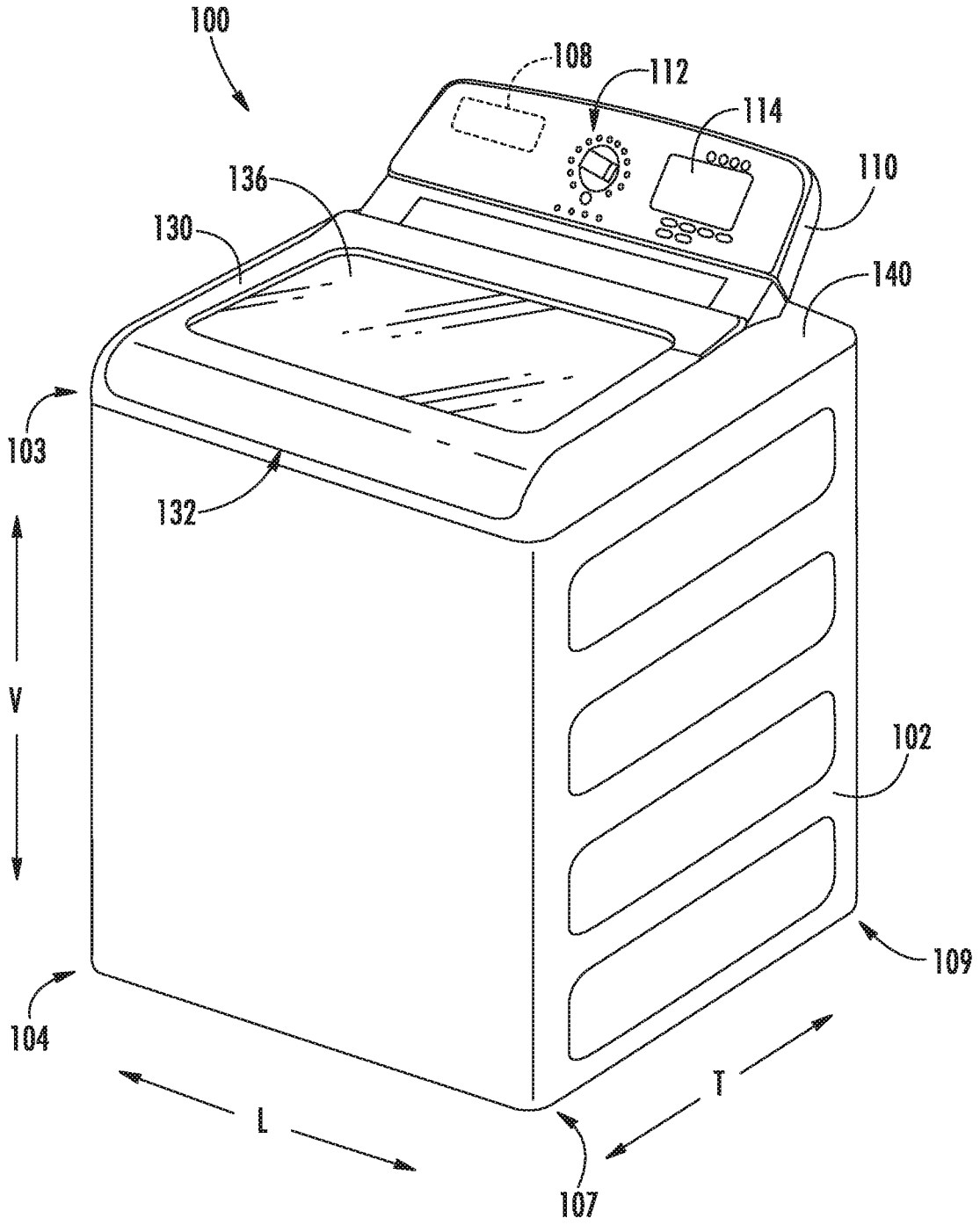
FIG. 1 provides a perspective view of a washing machine appliance according to an example embodiment of the present disclosure with a door of the example washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents. As used herein, terms of approximation, such as "approximately," "substantially," or "about," refer to being within a ten percent (10%) margin of error.

Figure 2:
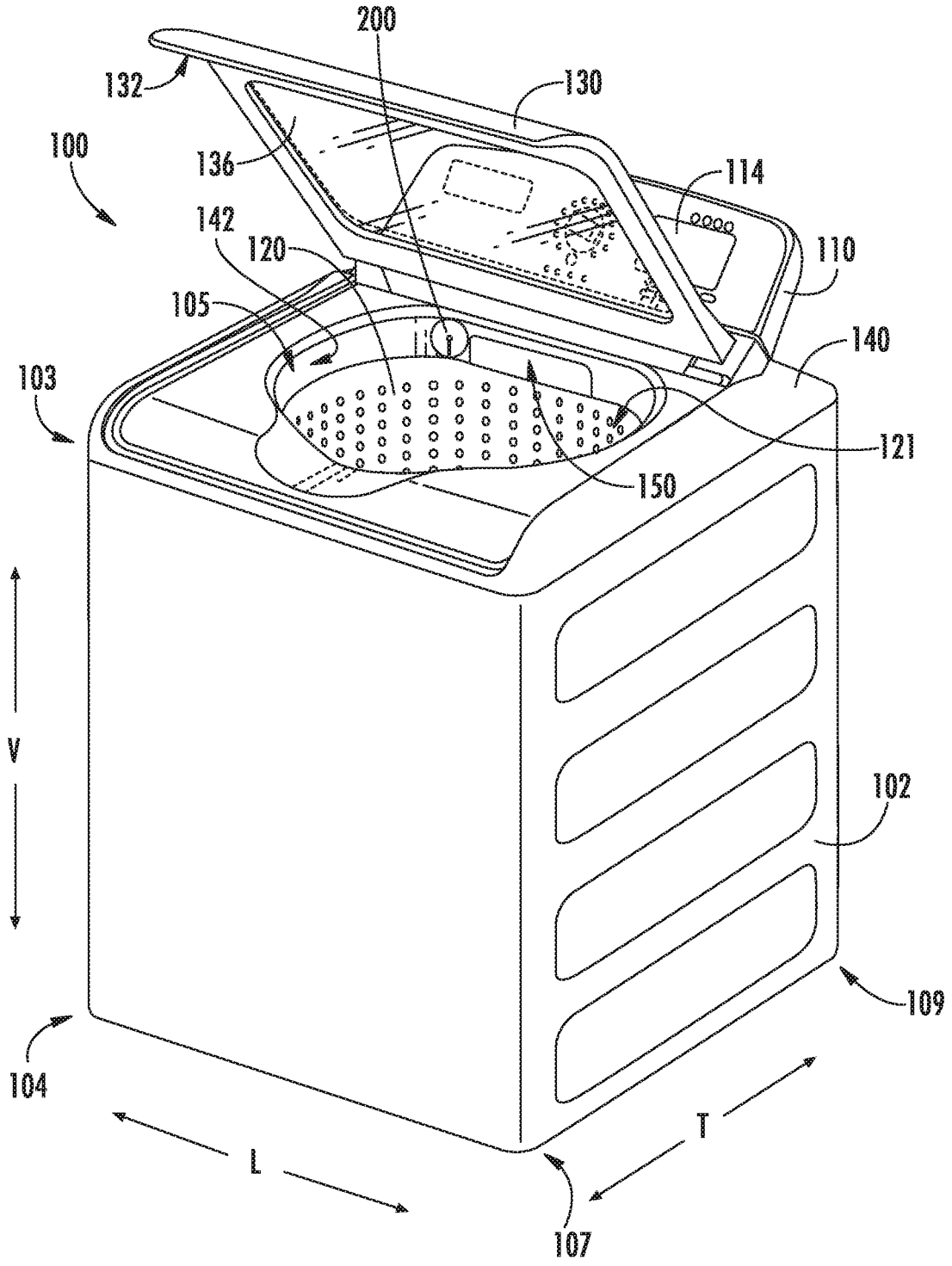
FIG. 2 provides a perspective view of the washing machine appliance of FIG. 1 with the door of the washing machine appliance shown in an open position.

FIGS. 1 and 2 illustrate one example appliance in which aspects of the present disclosure may be incorporated. In particular, FIGS. 1 and 2 provide perspective views of an example vertical axis washing machine appliance 100. In FIG. 1, a lid or door 130 of washing machine appliance 100 is shown in a closed position. In FIG. 2, door 130 is shown in an open position. For reference, washing machine appliance 100 defines a vertical direction V, a lateral direction L, and a transverse direction T, each of which is mutually perpendicular such that an orthogonal coordinate system is defined. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the teachings of the present disclosure as well, e.g., horizontal axis washing machines.

Washing machine appliance 100 has a cabinet 102 that extends between a top portion 103 and a bottom portion 104 along the vertical direction V and between a front 107 and a back 109 along the transverse direction T. A tub 122 (FIG. 3) is positioned within the cabinet 102. A wash basket 120 (FIG. 2) is rotatably mounted within tub 122 and defines a wash chamber 121 for receipt of articles for washing. A motor (not shown) is in mechanical communication with wash basket 120 to selectively rotate wash basket 120 about an axis of rotation (e.g., during an agitation or a rinse cycle of washing machine appliance 100). Tub 122 holds wash and rinse fluids for agitation in wash basket 120. An agitator or impeller (not shown) extends into wash basket 120 and is in mechanical communication with the motor. The impeller facilitates agitation of articles disposed within wash basket 120 during operation of washing machine appliance 100.

Cabinet 102 of washing machine appliance 100 has a top panel 140. Top panel 140 defines an opening 105 (FIG. 2) that permits user access to chamber 121 of wash basket 120. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support member.

A control panel 110 with at least one input selector 112 (FIG. 1) extends from or is positioned on top panel 140. Control panel 110 and input selector 112 collectively form a user interface for operator selection of machine cycles and features. A display 114 of control panel 110 indicates selected features, operation mode, a countdown timer, and/or other items of interest to appliance users regarding operation. Operation of washing machine appliance 100 is controlled by a controller 108 (FIG. 1) that is communicatively coupled with control panel 110. In response to user manipulation of control panel 110, e.g., manipulation of one of the input selectors 112, controller 108 operates washing machine appliance 100 to execute the selected machine cycles and/or features.

Controller 108 can include a memory and a processor, such as a general or special purpose microprocessor operable to execute programming instructions or micro-control code associated with a wash cycle. The memory can represent random access memory such as DRAM, or read only memory such as ROM or FLASH. In some embodiments, the processor executes programming instructions stored in memory. The memory can be a separate component from the processor or can be included onboard within the processor. Alternatively, controller 108 can be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 can be in communication with controller 108, e.g., via one or more signal lines or shared communication busses.

During operation of washing machine appliance 100, laundry items are loaded into wash basket 120 through opening 105, and washing operation is initiated through operator manipulation of input selectors 112 and/or via a remote user device. Wash basket 120 is filled with water and detergent and/or other fluid additives. One or more valves (e.g., water valve 170 of FIG. 3) can be controlled by washing machine appliance 100 to provide for filling wash basket 120 to the appropriate level for the amount of articles being washed and/or rinsed. By way of example, for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the wash cycle selected by a user. The impeller may again provide agitation within wash basket 120. One or more spin cycles also may be used. In particular, a spin cycle can be executed after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

As shown best in FIG. 2, washing machine appliance 100 includes an integrated cap cleaning device 200. Cap cleaning device 200 is operable to rinse detergent and/or softener caps, e.g., having leftover or residue liquid disposed thereon after use. As will be explained in detail herein, a soiled cap can be placed onto the cap cleaning device 200 for cleaning. A spray of water is actuated by pressing the soiled cap onto or into a docking port of cap cleaning device 200. The docking port is designed to accommodate a wide range of cap diameters. The spray of water is directed into and onto the surfaces of the soiled cap. A portion of water is directed into the cap to remove residue therein. In some embodiments, a portion of water can be directed onto the external surfaces of the cap, e.g., to clean a rim or flange of the cap. The spray of water is delivered for a predetermined time, e.g., five seconds (5 s), or until the cap is removed from the docking port. As a result, the soiled cap is cleaned. Cleaning of the cap is made convenient and easy with cap cleaning device 200 as cleaning can take place at washing machine appliance 100 (e.g., there is no need to take the soiled cap to a nearby sink) and the water used to clean the cap can be poured into wash basket 120. Further, as the cap is cleaned while in the docking port of cap cleaning device 200, the spray of water is contained within the cleaning area. Other advantages and benefits of cap cleaning device 200 will be appreciated in view the description and drawings of the present disclosure.

For this embodiment, cap cleaning device 200 is mounted to an interior surface 142 of top panel 140 at a rear portion of opening 105. That is, cap cleaning device 200 is mounted to an interior surface 142 of top panel 140 at or within opening 105. Cap cleaning device 200 can be mounted to the side of a dispenser assembly 150, for example. Advantageously, by mounting cap cleaning device 200 to interior surface 142 of top panel 140, the water sprayed onto a soiled cap can readily runoff or be poured into wash basket 120 during or after cleaning of the soiled cap. Furthermore, in some embodiments, cap cleaning device 200 can be integrally formed with top cover 140 as a single monolithic piece. In alternative embodiments, cap cleaning device 200 can be mounted to any suitable location on washing machine appliance 100.

Figure 3:
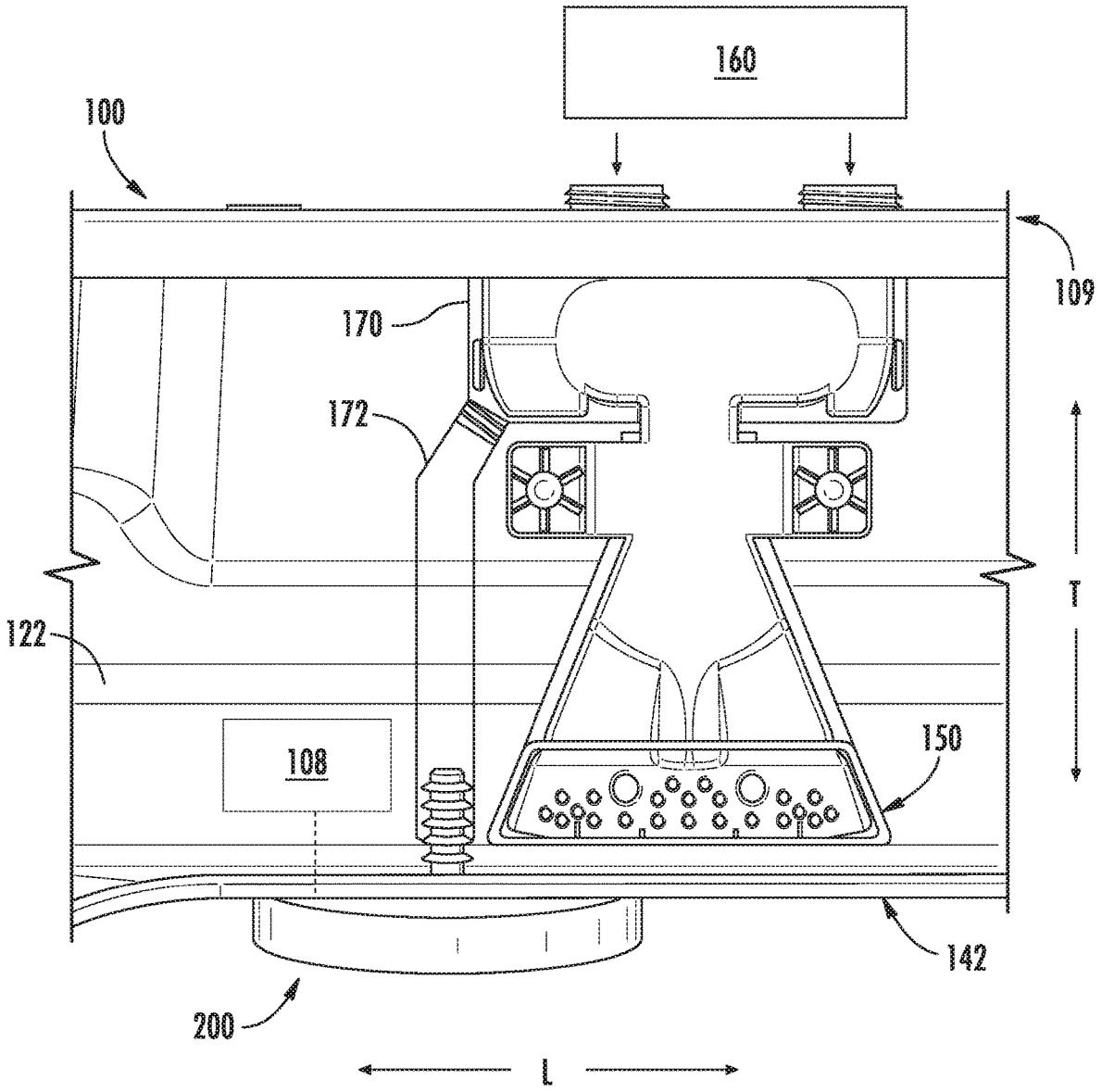
FIG. 3 provides a top schematic view of the washing machine appliance of FIG. 1 depicting various components thereof.

FIG. 3 provides a top schematic view of washing machine appliance 100 depicting various components thereof, including cap cleaning device 200. As shown, washing machine appliance 100 is in fluid communication with a water supply 160, e.g., a municipal water line, well, etc. Washing machine appliance 100 includes a water valve 170. Water valve 170 can be an inlet water valve of the washing machine appliance 100. Water valve 170 can selectively allow water to flow from water supply 160 to various components of washing machine appliance 100. For instance, water valve 170 can selectively allow water to flow from water supply 160 to dispensing assembly 150, e.g., so that water can fill into wash chamber 121 of wash basket 120 (FIG. 2). Furthermore, for this embodiment, water valve 170 can selectively allow water to flow from water supply 160 to cap cleaning device 200, e.g., when activated or triggered. As depicted, water valve 170 and cap cleaning device 200 are fluidly connected by supply conduit 172. Water valve 170 is movable between an open position and a closed position. In the open position, water valve 170 permits or allows water to flow from water supply 160 to cap cleaning device 200. In contrast, in the closed position, water valve 170 or prevents water from flowing from water supply 160 to cap cleaning device 200.

Figure 4:
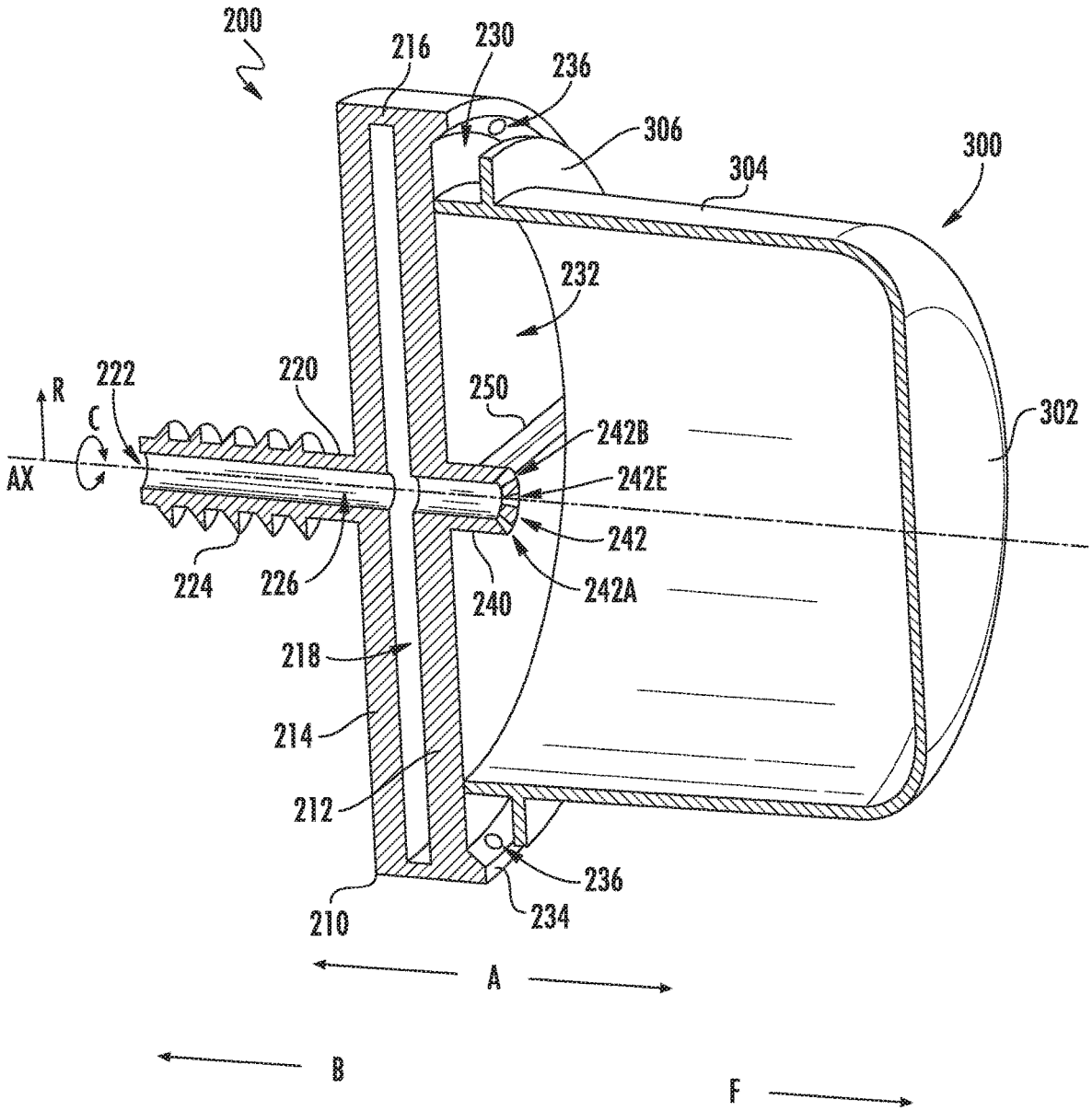
FIG. 4 provides a perspective cross-sectional view of a cap cleaning device of the washing machine appliance of FIGS. 1 and 2.

FIG. 4 provides a perspective cross-sectional view of cap cleaning device 200 of washing machine appliance 100 with a cap 300 docked therewith. As shown, for reference purposes, cap cleaning device 200 defines an axial direction A, a radial direction R, and a circumferential direction C. Cap Cleaning device 200 also defines an axial centerline AX that extends along the axial direction A. The radial direction R extends inward toward and outward from the axial centerline AX in a direction orthogonal to the axial direction A in the circumferential direction C extends around the axial centerline AX, e.g., three hundred sixty degrees (360°). In addition, a forward direction F and a backward direction B (a direction opposite the forward direction F) are shown extending along the axial direction A.

Cap cleaning device 200 includes a body 210. Body 210 can be formed of any suitable material, such as e.g., plastic. Body 210 has a first wall 212, a second wall 214 spaced from first wall 212 along the axial direction A, and a sidewall 216 extending between and connecting first wall 212 and second wall 214 along the axial direction A. Sidewall 216 also extends along the circumferential direction C as shown in FIG. 4. For this embodiment, first wall 212 is a front wall and second wall 214 is a back wall; thus, first wall 212 is positioned forward of second wall 214 along the axial direction A. First wall 212, second wall 214, and sidewall 216 collectively define an interior chamber 218 operable to receive water therein. For the depicted embodiment, interior chamber 218 is generally cylindrical and has a depth extending along the actual direction A.

Body 210 of cap cleaning device 200 includes an inlet port 220 that defines an inlet 222 of cap cleaning device 200. Inlet port 220 projects backward from second wall 214 (i.e., in a direction along the backward direction B) and extends longitudinally along the axial direction A. Inlet port 220 is generally cylindrical but has a plurality of barbed projections 224 projecting from an outer surface of inlet port 220. The barbed projections 224 project outward from the outer surface of inlet port 220 along the radial direction R. The barbed projections 224 facilitate the mating engagement of supply conduit 172 with cap cleaning device 200, e.g., as shown best in FIG. 3. The barbed projections 224 engage supply conduit 172 to retain supply conduit 172 in place and function to seal supply conduit 172 with cap cleaning device 200. As further shown in FIG. 4, inlet port 220 defines at least a portion of a delivery passage 226 that fluidly connects inlet 222 and interior chamber 218. In this way, when water is delivered to cap cleaning device 200, water enters cap cleaning device 200 through inlet 222, flows along delivery passage 226, and at least a portion of the water flows into interior chamber 218.

As further depicted in FIG. 4, body 210 defines a docking port 230 operable to receive cap 300. Particularly, as shown, first wall 212 has a docking surface 232 that extends in a plane orthogonal to the axial direction A. Docking surface 232 is generally circular and has a diameter that is sized to receive a wide range of caps. In other embodiments, docking surface 232 can have other suitable shapes, such as e.g., a hexagon or octagon. Moreover, docking surface 232 is generally planar so that cap 300 can be pressed flush with docking surface 232 when cap 300 is received by docking port 230. In this way, when water is sprayed into cap 300, the water sprayed therein is contained by 300 and docking surface 232, which prevents splashing during cleaning of caps 300. As further shown in FIG. 4, body 210 has an outer rim 234 that projects forward from first wall 212 along the axial direction A. For this embodiment, outer rim 234 extends along the circumferential direction C along the entirety of the outer perimeter of body 210 and is generally an extension of sidewall 216. Docking surface 232 is recessed or position backward of the forward most surface of outer rim 234. Docking surface 232 and outer rim 234 collectively define docking port 230.

As further shown in FIG. 4, outer rim 234 of body 210 defines one or more rim exit nozzles 236. For this embodiment, outer rim 234 defines a plurality of rim exit nozzles 236 that are spaced from one another along the circumferential direction C. The rim exit nozzles 236 are fluidly connected with the interior chamber 218. Accordingly, when water is delivered to cap cleaning device 200 from water supply 160 (FIG. 3), water enters cap cleaning device 200 through inlet 222 of inlet port 220, flows along delivery passage 226 through inlet port 220, and a portion of the water flows into interior chamber 218. The water exits cap cleaning device 200 through rim exit nozzles 236 and sprays onto cap 300. Particularly, cap 300 has a base wall 302, a sidewall 304, and a flange 306 extending circumferentially around an outer surface of sidewall 304. When water exits through rim exit nozzles 236, water is sprayed onto the exterior surfaces of sidewall 304 and flange 306 of cap 300. In this manner, liquid residue from a cleaning agent (e.g., detergent) can be removed therefrom such that the soiled cap can be cleaned. In some alternative embodiments, outer rim 234 of body 210 does not define any rim exit nozzles 236.

Body 210 of cap cleaning device 200 also includes a spout 240. Spout 240 projects forward from first wall 212 and extends longitudinally along the axial direction A. Spout 240 is generally centered on the docking port 230. That is, spout 240 is positioned at the center of circular docking surface 232. Spout 240 defines at least a portion of the delivery passage 226 and also defines one or more exit nozzles, denoted generally by 242. The exit nozzles 242 are fluidly connected with the interior chamber 218 as well as the portion of the delivery passage 226 defined by inlet port 220 as shown in FIG. 4. In this way, when water is delivered to cap cleaning device 200 from water supply 160 (FIG. 3), water enters cap cleaning device 200 through inlet 222, flows along delivery passage 226 through inlet port 220, a portion of the water flows into interior chamber 218 and a portion of water flows from interior chamber 218 and into the delivery passage 226 defined by spout 240. The water exits spout 240 through exit nozzles 242 and sprays into cap 300. Particularly, when water exits spout 240 through exit nozzles 242, water is sprayed onto the interior surfaces of base wall 302 and sidewall 304 of cap 300. In this manner, liquid residue from a cleaning agent (e.g., detergent) can be removed therefrom such that the soiled cap can be cleaned.

For this embodiment, the one or more exit nozzles 242 defined by spout 240 include a first exit nozzle 242A and a second exit nozzle 242B, e.g., as shown in FIG. 4. In such embodiments, first exit nozzle 242A is positioned opposite second exit nozzle 242B along the radial direction R. That is, first exit nozzle 242A is positioned one hundred eighty degrees (180°) from second exit nozzle 242B along the circumferential direction C. Further, first exit nozzle 242A and second exit nozzle 242B can be angled with respect to the axial direction A. In this manner, some water can be sprayed from spout 240 directly onto the interior surfaces of sidewall 304 of cap 300. Further, for this embodiment, spout 240 defines an exit nozzle 242E that extends parallel along the axial direction A such that water can be sprayed directly onto base wall 302 of cap 300.

Figure 5:
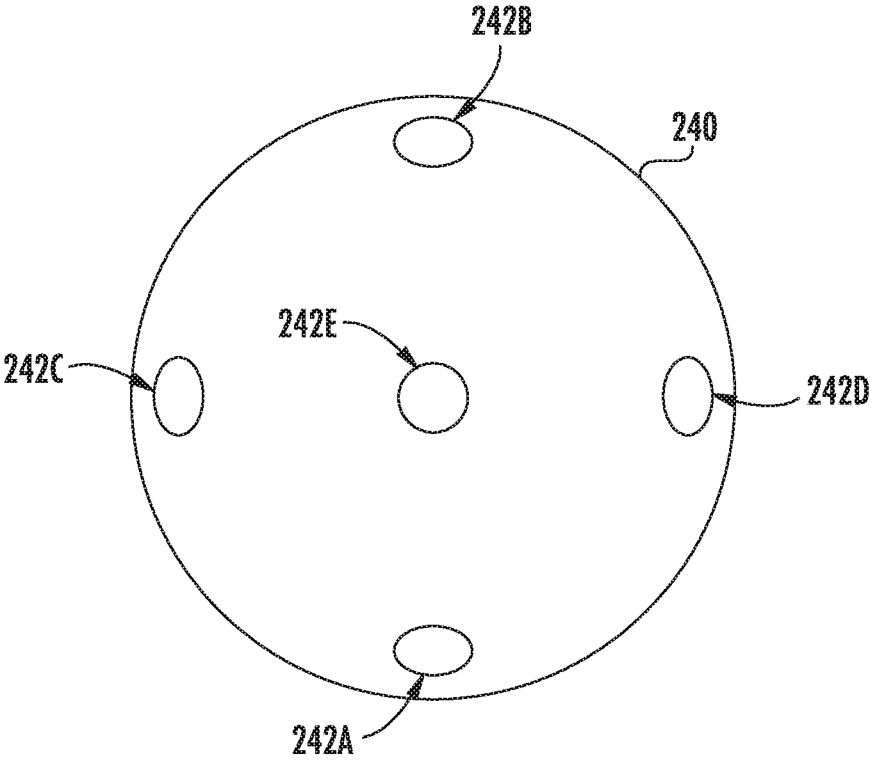
FIG. 5 provides a schematic view of an example spout that can be employed with the cap cleaning device of FIG. 4.

FIG. 5 provides a schematic view of another example spout 240 that can be employed with cap cleaning device 200. As shown, the one or more exit nozzles defined by spout 240 include a third exit nozzle 242C and a fourth exit nozzle 242D in addition to first exit nozzle 242A and second exit nozzle 242B described above. In such embodiments, third exit nozzle 242C is positioned opposite fourth exit nozzle 242D along the radial direction R (i.e., so that third exit nozzle 242C is positioned one hundred eighty degrees (180°) from fourth exit nozzle 242D along the circumferential direction C). Further, third exit nozzle 242C is positioned about ninety degrees (90°) from first exit nozzle 242A along the circumferential direction C and fourth exit nozzle 242D is positioned about ninety degrees (90°) from second exit nozzle 242B along the circumferential direction C. Third exit nozzle 242C and fourth exit nozzle 242D can be angled with respect to the axial direction A. In this way, water flows through the plurality of exit nozzles 242A. 242B, 242C, 242D and sprays cap 300 at least at every ninety degrees (90°) along the circumferential direction C.

Returning to FIG. 4, as depicted, cap cleaning device 200 further includes an activation device 250. Activation device 250 is mounted to body 210 and is communicatively coupled with controller 108, e.g., as shown in FIG. 3. Particularly, activation device 250 is mounted to first wall 212 and extends longitudinally between spout 240 and outer rim 234 along the radial direction R. In this way, when cap 300 is received by docking port 230 of cap cleaning device 200 as shown in FIG. 4, cap 300 can depress activation device 250. For this embodiment, activation device 250 is a switch that can be depressed to activate or trigger cap cleaning device 200 to perform a cap cleaning cycle. When activation device 250 is depressed (e.g., by cap 300), a cap cleaning cycle is initiated such that water is delivered or directed to spout 240 and sprayed therefrom. When cap 300 is removed from docking port 230 (e.g., as shown in FIG. 2) or if a predetermined activation time has elapsed, the cap cleaning cycle is terminated such that water is not delivered to spout 240. In some embodiments, the predetermined activation time is about five seconds (5 s).

Figure 6:
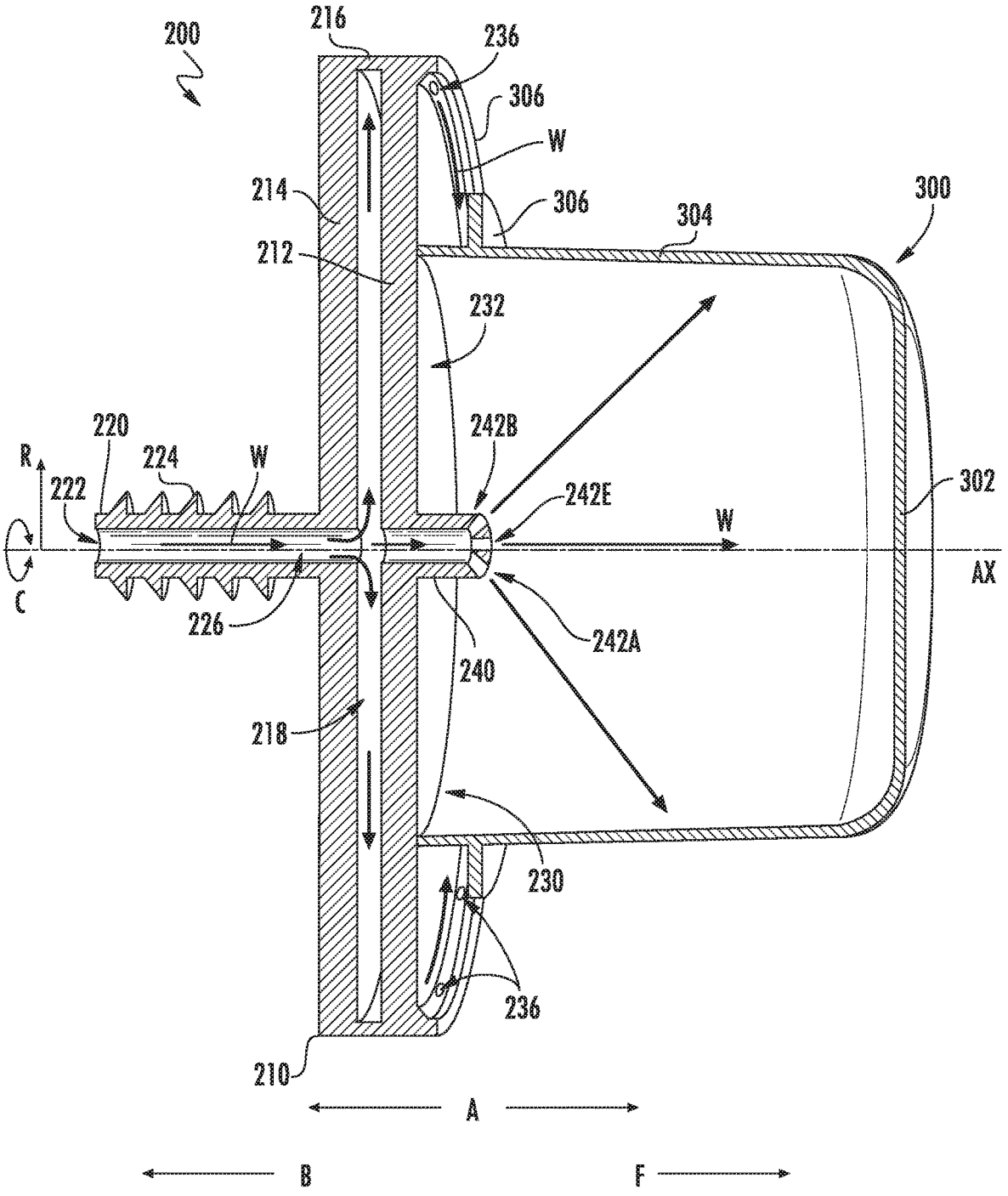
FIG. 6 provides another perspective cross-sectional view of the cap cleaning device of FIG. 4 and depicts water being sprayed therefrom.

A cap cleaning cycle can be performed by cap cleaning device 200 of washing machine appliance 100 to clean a soiled cap in the following example manner with general reference to FIGS. 3, 4, and 6. FIG. 6 provides another perspective cross-sectional view of cap cleaning device 200 and depicts water being sprayed therefrom. As noted previously, after cap 300 is used to pour a liquid cleaning agent into wash basket 120 (FIG. 2) to enhance the washing performance of the articles, residue can remain in or on cap 300. Accordingly, in accordance with the inventive aspects of the present disclosure, a user can clean the soiled cap 300 using integrated cap cleaning device 200. To initiate cleaning of the soiled cap 300 with cap cleaning device 200, soiled cap 300 is pressed into and received by docking port 230. When cap 300 is received by docking port 230 of cap cleaning device 200, cap 300 engages activation device 250. More specifically, cap 300 depresses activation device 250, which ultimately initiates washing machine appliance 100 (FIG. 1) in a cap cleaning cycle utilizing cap cleaning device 200.

When activation device 250 is depressed, an activation signal is routed from activation device 250 to controller 108. In response, controller 108 causes water valve 170 to move to the open position so that water is delivered to spout 240 and sprayed onto cap 300 received by the docking port 230 of cap cleaning device 200. Specifically, when controller 108 receives the activation signal indicating that activation device 250 has been activated, controller 108 sends a command signal to water valve 170. The command signal can include instructions for actuating water valve 170 to the open position so that water can flow from water supply 160 to water valve 170 and to cap cleaning device 200 via supply conduit 172.

Water enters cap cleaning device 200 through inlet 222 of inlet port 220. The water flows downstream along delivery passage 226 where the water eventually reaches interior chamber 218 defined by body 210. At least a portion of the water flows into interior chamber 218. During a cap cleaning cycle, interior chamber 218 can become becomes completely full with water. Some of the water contained within interior chamber 218 exits interior chamber 218 through rim exit nozzles 236 defined by outer rim 234. As shown best in FIG. 6, water W can exit through rim exit nozzles 236 and spray onto the exterior surfaces of sidewall 304 of cap 300. Notably, the rim exit nozzles 236 can be defined by outer rim 234 such that water W exiting the rim exit nozzles 236 can be sprayed directly onto flange 306 and the top end of cap 300 that defines the opening of cap 300. In this way, the exterior surfaces of cap 300 that are most likely to have liquid residue thereon are directly sprayed with water W by cap cleaning device 200.

Some of the water contained within interior chamber 218 exits interior chamber 218 and continues downstream along delivery passage 226 into spout 240. Water flows downstream through delivery passage 226 through spout 240 and exits spout 240 via exit nozzles 242. The water through exit nozzles 242 and sprays into cap 300. Specifically, when water exits spout 240 through exit nozzles 242, water is sprayed onto the interior surfaces of base wall 302 and sidewall 304 of cap 300. In this manner, liquid residue from a cleaning agent (e.g., detergent) can be removed therefrom such that the soiled cap can be cleaned.

After causing water valve 170 to move to the open position so that water is delivered to spout 240 and sprayed onto cap 300 received by docking port 230, controller 108 is further configured to cause, after a predetermined activation time, water valve 170 to move to the closed position so that water is not delivered to spout 240, or more generally, cap cleaning device 200. For instance, if the predetermined activation time has elapsed, controller 108 can send a deactivation command signal to water valve 170 regardless of whether activation device 250 is still depressed. The deactivation command signal can include instructions for actuating water valve 170 to the closed position so that water is prevented from flowing from water valve 170 to cap cleaning device 200 via supply conduit 172. In some embodiments, the predetermined activation time is about five seconds (5 s). In yet other embodiments, the predetermined activation time is about eight seconds (8 s). If activation device 250 is released, e.g., by removing cap 300 from the docking port 230, prior to the predetermined activation time elapsing, then controller 108 can cause water valve 170 to move to the closed position so that water is not delivered to spout 240, or more generally, cap cleaning device 200. If a user should desire to clean cap 300 once again or repeat the cap cleaning cycle, a user can reinitiate the cycle by depressing activation device 250 once more. After undergoing a cap cleaning cycle, the previously soiled cap can be rendered clean. As noted previously, cleaning of the cap is made convenient and easy with cap cleaning device 200.

Figure 7:
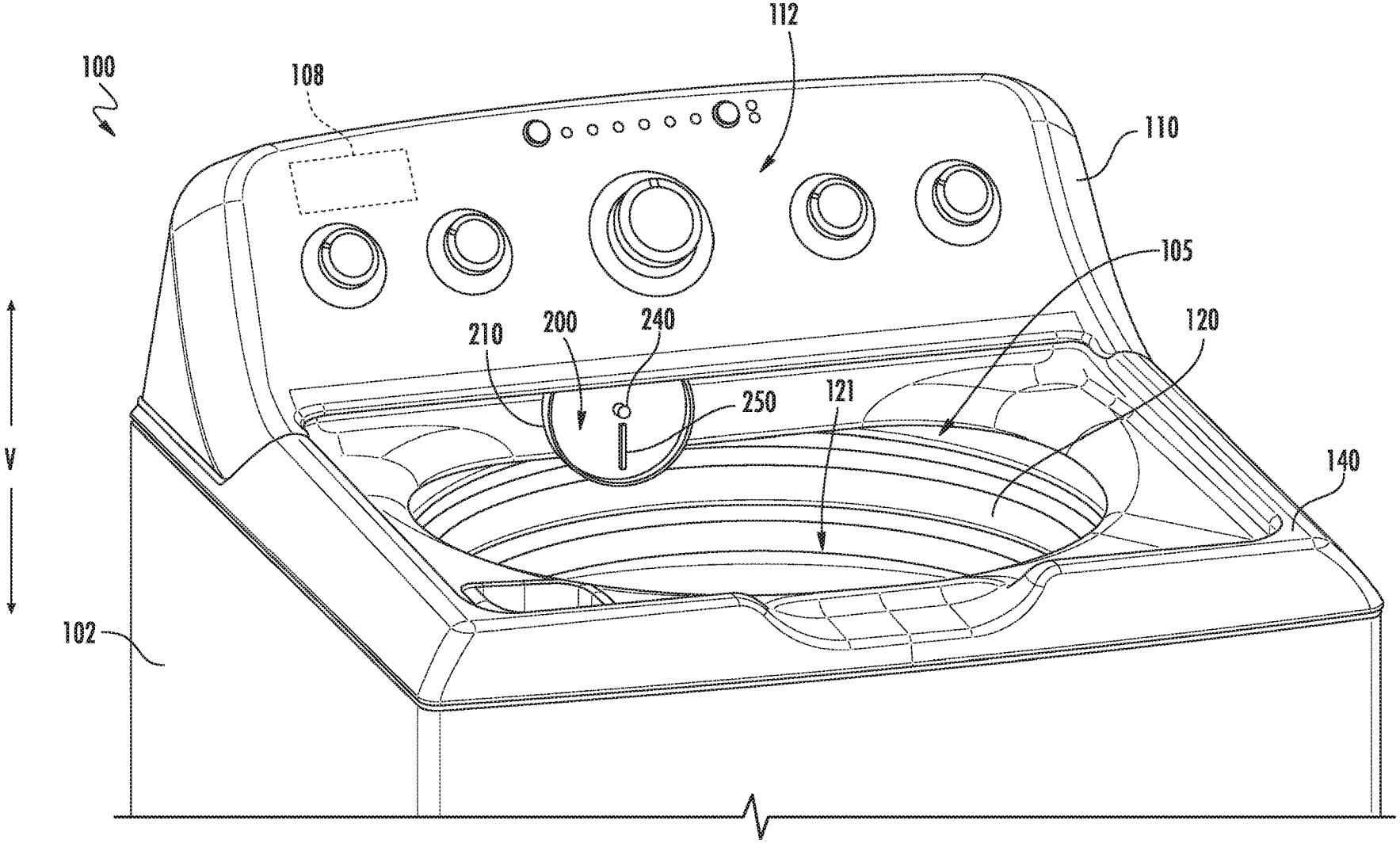
FIG. 7 provides a close up perspective view of a top portion of a washing machine appliance and depicts an example cap cleaning device thereof according to an example embodiment of the present disclosure.

FIG. 7 provides a close up perspective view of a top portion of another example washing machine appliance 100 and depicts an example cap cleaning device 200 thereof according to an example embodiment of the present disclosure. For this embodiment, cap cleaning device 200 is similarly configured as the cap cleaning device described herein. Particularly, cap cleaning device 200 includes body 210, spout 240, and activation device 250. However, as depicted, body 210 of cap cleaning device 200 is not circular; rather body 210 has a partial circular shape with a top portion of body 210 cutoff. In such embodiments, more space may be provided for door 130 (FIG. 1) to close. Spout 240 can be positioned off center and more toward the top of body 210 as shown in FIG. 7 in such embodiments.

Figure 8:
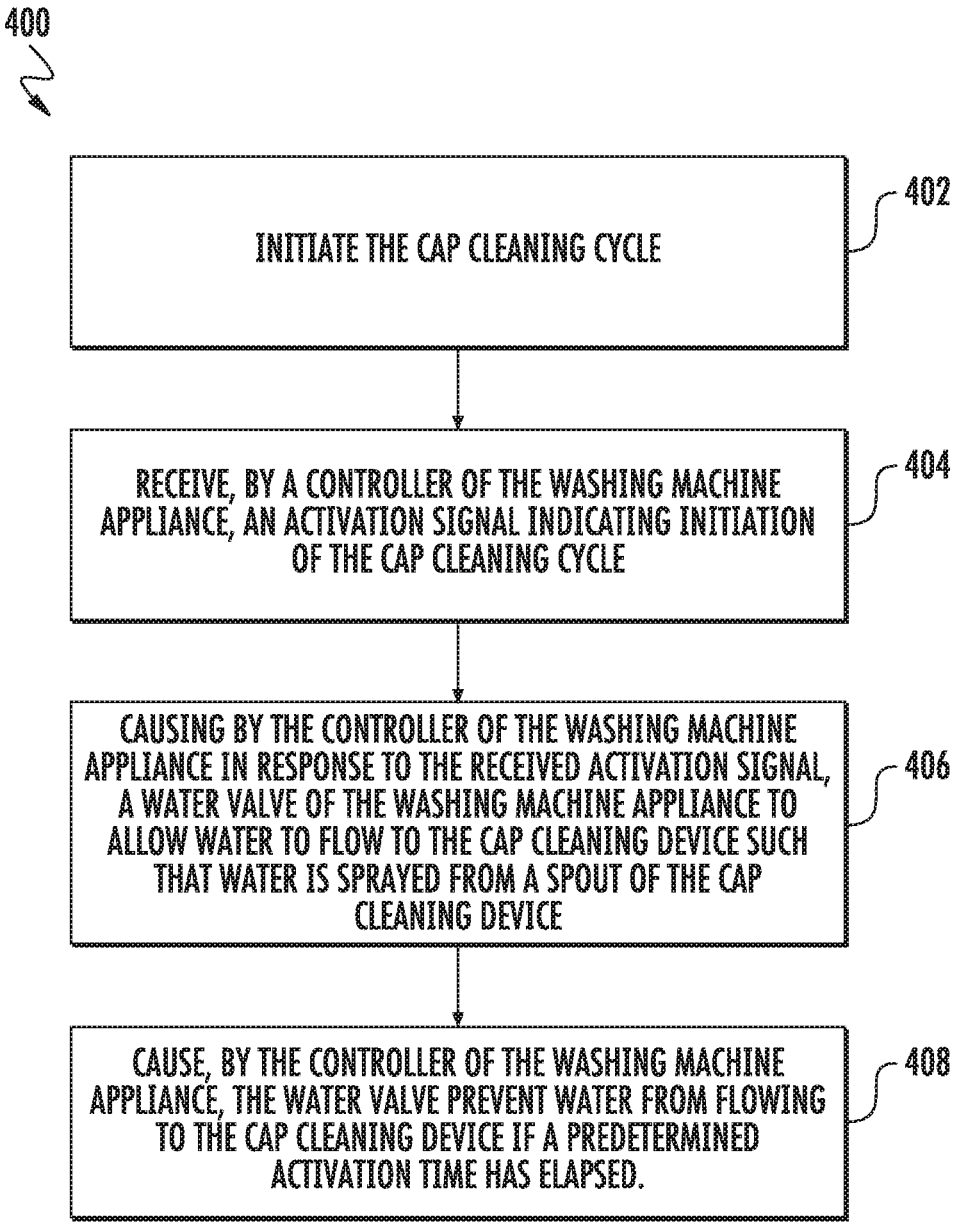
FIG. 8 provides a flow diagram of a method for operating a washing machine appliance in a cap cleaning cycle using a cap cleaning device according to an example embodiment of the present disclosure.

FIG. 8 provides a flow diagram of a method (400) for operating a washing machine appliance in a cap cleaning cycle using a cap cleaning device according to an example embodiment of the present disclosure. Method (400) can be implemented with any suitable laundry appliance, including for example, vertical axis washing machine appliance 100 of FIGS. 1 through 2. To provide context to method (400), reference numerals utilized to describe the features of washing machine appliance 100 in FIGS. 1 through 2 and cap cleaning device 200 will be used below. In addition, it will be appreciated that exemplary method (400) can be modified, adapted, expanded, rearranged and/or omitted in various ways without deviating from the scope of the present subject matter.

At (402), the method (400) includes initiating the cap cleaning cycle. For instance, in some implementations, initiating the cap cleaning cycle can include depressing an activation device of a cap cleaning device, such as cap cleaning device 200 provided herein. For instance, cap cleaning device 200 can be mounted to top panel 140 at or within opening 105, e.g., as shown in FIG. 2. The activation device can be depressed by a user pressing a soiled cap against the activation device, for example. With reference to FIG. 4, to initiate cleaning of soiled cap 300 with cap cleaning device 200, the soiled cap 300 can be pressed into and received by docking port 230 of cap cleaning device 200. When cap 300 is received by docking port 230 of cap cleaning device 200, cap 300 engages or triggers activation device 250. More specifically, cap 300 depresses activation device 250, e.g., into a recess defined by first wall 212 of body 210. In some implementations, activation device 250 extends longitudinally between spout 240 and outer rim 234 along the radial direction R so that cap 300 can easily contact and engage activation device 250. In some alternative implementations, the activation device 250 can be located offboard of the cap cleaning device 200. For instance, activation 250 can be one of the input selectors 112 of control panel 110 (FIG. 1) or a graphic presented on display 114.

At (404), the method (400) includes receiving, by a controller of the washing machine appliance, an activation signal indicating initiation of the cap cleaning cycle. For instance, when activation device 250 is depressed, an activation signal is routed from activation device 250 to controller 108 indicating initiation of the cap cleaning cycle.

At (406), the method (400) includes causing, by the controller of the washing machine appliance, a water valve of the washing machine appliance to allow water to flow to the cap cleaning device such that water is sprayed from a spout of the cap cleaning device based at least in part on the received activation signal. For instance, with reference to FIGS. 3 and 4, in response to the received activation signal, controller 108 causes water valve 170 to move to the open position so that water is directed to spout 240 and sprayed onto cap 300 received by the docking port 230 of cap cleaning device 200. Specifically, when controller 108 receives the activation signal indicating that activation device 250 has been activated, controller 108 sends a command signal to water valve 170. The command signal can include instructions for actuating water valve 170 to the open position so that water can flow from water supply 160 to water valve 170 and to cap cleaning device 200 via supply conduit 172. In some implementations, spout 240 defines a plurality of exit nozzles 242 through which water exits spout 240 and sprays onto cap 300. For instance, spout 240 can include some or all of the plurality of exit nozzles 242 shown in FIG. 4 or FIG. 5. In yet other implementations, spout 240 defines a plurality of exit nozzles 242 such that water exits through the exit nozzles 242 and onto cap 300 in a hemispherical spray pattern.

In some implementations, as shown in FIG. 6, body 210 of cap cleaning device 200 has docking surface 232 that extends in a plane orthogonal to the axial direction A and outer rim 234 that extends around a perimeter of docking surface 232 along the circumferential direction C. Outer rim 234 defines a plurality of rim exit nozzles 236 spaced from one another along the circumferential direction C. In such implementations, during causing, by the controller of the washing machine appliance, the water valve of the washing machine appliance to allow water to flow to the cap cleaning device at (406), water exits through the rim exit nozzles 236 and onto cap 300 as illustrated in FIG. 6. In this way, the exterior surfaces of cap 300 can be cleaned.

At (408), the method (400) includes causing, by the controller of the washing machine appliance, the water valve to prevent water from flowing to the cap cleaning device if a predetermined activation time has elapsed or if the activation device has been disengaged. For instance, with reference to FIGS. 3 and 4, if the predetermined activation time has elapsed, controller 108 can send a deactivation command signal to water valve 170 regardless of whether activation device 250 is still depressed. The deactivation command signal can include instructions for actuating water valve 170 to the closed position so that water is prevented from flowing from water valve 170 to cap cleaning device 200 via supply conduit 172. In some implementations, the predetermined activation time is about five seconds (5 s). In yet other implementations, the predetermined activation time is about eight seconds (8 s).

If activation device 250 is released, e.g., by removing cap 300 from the docking port 230, prior to the predetermined activation time elapsing, then controller 108 can cause water valve 170 to move to the closed position so that water is not delivered to spout 240, or more generally, cap cleaning device 200. To repeat the cap cleaning cycle, a user can reinitiate the cycle by depressing or triggering activation device 250 once more. After undergoing the cap cleaning cycle, the previously soiled cap can be rendered clean.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet;

a tub positioned within the cabinet;

a basket rotatably mounted within the tub, the basket defining a wash chamber for receipt of articles for washing;

a controller;

a water valve movable between an open position and a closed position;

a cap cleaning device defining an axial direction, a radial direction, an axial centerline extending along the axial direction, and a circumferential direction extending around the axial centerline, comprising:

a body in fluid communication with the water valve and defining a docking port operable to receive a cap, the body having a spout, and wherein the body includes a first wall having a docking surface that extends in a plane orthogonal to the axial direction and an outer rim extending around a perimeter of the docking surface along the circumferential direction, wherein the docking surface is recessed with respect to the outer rim along the axial direction, and wherein the docking surface and the outer rim collectively define the docking port; and a switch mounted to the body and communicatively coupled with the controller, wherein, when the switch is triggered, the controller causes the water valve to move to the open position such that water is directed to the spout and sprayed therefrom.

2. The washing machine appliance of claim 1, further comprising:

a top cover mounted to the cabinet, and wherein the cap cleaning device is mounted to or integral with the top cover.

3. The washing machine appliance of claim 1, wherein the body of the cap cleaning device has an inlet port defining an inlet, and wherein the inlet port defines a plurality of barbed projections projecting from the inlet port.

4. The washing machine appliance of claim 1, wherein the body has a second wall spaced from the first wall along the axial direction, and a sidewall extending between and connecting the first wall and the second wall along the axial direction, and wherein the first wall, the second wall, and the sidewall collectively define an interior chamber for holding water.

5. The washing machine appliance of claim 1, wherein the outer rim defines a plurality of rim exit nozzles spaced from one another along the circumferential direction, and wherein, when the switch is triggered, the controller causes the water valve to move to the open position such that water is directed to the rim exit nozzles and sprayed therefrom.

6. The washing machine appliance of claim 1, wherein the spout defines a plurality of exit nozzles through which water exits the spout.

7. The washing machine appliance of claim 6, wherein the spout extends longitudinally along the axial direction and wherein the plurality of exit nozzles defined by the spout include a first exit nozzle and a second exit nozzle, and wherein the first exit nozzle is positioned opposite the second exit nozzle along the radial direction.

8. The washing machine appliance of claim 7, wherein the plurality of exit nozzles defined by the spout include a third exit nozzle and a fourth exit nozzle, and wherein the third exit nozzle is positioned opposite the fourth exit nozzle along the radial direction, and wherein the third exit nozzle is positioned about ninety degrees (90°) from the first exit nozzle along the circumferential direction and the fourth exit nozzle is positioned about ninety degrees (90°) from the second exit nozzle along the circumferential direction.

9. The washing machine appliance of claim 6, wherein the spout extends longitudinally along the axial direction and the plurality of exit nozzles defined by the spout include an exit nozzle that extends parallel to the axial direction.

10. A washing machine appliance, comprising:

a cabinet;

a tub positioned within the cabinet;

a basket rotatably mounted within the tub, the basket defining a wash chamber for receipt of articles for washing;

a controller;

a water valve movable between an open position and a closed position;

a cap cleaning device defining an axial direction, a radial direction, an axial centerline extending along the axial direction, and a circumferential direction extending around the axial centerline, comprising:

a body in fluid communication with the water valve and defining a docking port operable to receive a cap, the body having an inlet port defining an inlet through which water enters the cap cleaning device, the body also having a spout defining one or more exit nozzles through which water exits the cap cleaning device, and wherein the body includes a first wall having a docking surface that extends in a plane orthogonal to the axial direction and an outer rim extending around a perimeter of the docking surface along the circumferential direction, wherein the docking surface and the outer rim collectively define the docking port, and wherein the spout projects from and extends longitudinally from the docking surface of the first wall along the axial direction; and a switch mounted to the body and communicatively coupled with the controller, the switch extending longitudinally between the spout and the outer rim along the radial direction, and wherein when the switch is triggered, the controller is configured to:

receive, from the switch, an activation signal indicating that the switch is triggered; and cause the water valve to move to the open position so that water is directed to the spout and sprayed through the one or more exit nozzles.

11. The washing machine appliance of claim 10, wherein after causing the water valve to move to the open position so that water is delivered to the spout and sprayed therefrom, the controller is further configured to:

cause, if a predetermined activation time has elapsed, the water valve to move to the closed position so that water is not directed to the spout.

12. The washing machine appliance of claim 11, wherein the predetermined activation time is about five seconds.

13. A washing machine appliance, comprising:

a cabinet;

a tub positioned within the cabinet;

a basket rotatably mounted within the tub, the basket defining a wash chamber for receipt of articles for washing;

a controller;

a water valve movable between an open position and a closed position;

a cap cleaning device defining an axial direction, a radial direction, and a circumferential direction, the cap cleaning device comprising:

a body in fluid communication with the water valve and defining a docking port operable to receive a cap, the body having a spout defining a plurality of exit nozzles through which water exits the spout, and wherein the spout extends longitudinally along the axial direction and the plurality of exit nozzles defined by the spout include an exit nozzle that extends parallel to the axial direction; and a switch mounted to the body and communicatively coupled with the controller, wherein, when the switch is triggered, the controller causes the water valve to move to the open position such that water is directed to the spout and sprayed therefrom.

14. The washing machine appliance of claim 13, wherein the plurality of exit nozzles defined by the spout include a first exit nozzle and a second exit nozzle, and wherein the first exit nozzle is positioned opposite the second exit nozzle along the radial direction.

15. The washing machine appliance of claim 14, wherein the plurality of exit nozzles defined by the spout include a third exit nozzle and a fourth exit nozzle, and wherein the third exit nozzle is positioned opposite the fourth exit nozzle along the radial direction, and wherein the third exit nozzle is positioned about ninety degrees (90°) from the first exit nozzle along the circumferential direction and the fourth exit nozzle is positioned about ninety degrees (90°) from the second exit nozzle along the circumferential direction.

16. The washing machine appliance of claim 13, wherein the cap cleaning device defines an axial centerline extending along the axial direction, and wherein the body includes a first wall having a docking surface that extends in a plane orthogonal to the axial direction and an outer rim extending around a perimeter of the docking surface along the circumferential direction, wherein the docking surface is recessed with respect to the outer rim along the axial direction, and wherein the docking surface and the outer rim collectively define the docking port.

17. The washing machine appliance of claim 13, wherein the cap cleaning device defines an axial centerline extending along the axial direction, and wherein the body has a first wall, a second wall spaced from the first wall along the axial direction, and a sidewall extending between and connecting the first wall and the second wall along the axial direction, and wherein the first wall, the second wall, and the sidewall collectively define an interior chamber for holding water.

18. The washing machine appliance of claim 13, wherein the body has a docking surface that extends in a plane orthogonal to the axial direction and an outer rim extending around a perimeter of the docking surface along the circumferential direction, and wherein the outer rim defines a plurality of rim exit nozzles spaced from one another along the circumferential direction, and wherein, when the switch is triggered, the controller causes the water valve to move to the open position such that water is directed to the rim exit nozzles and sprayed therefrom.

* * * * *